US007013648B2

(12) United States Patent
Griffin et al.

(10) Patent No.: US 7,013,648 B2
(45) Date of Patent: Mar. 21, 2006

(54) PREMIX BURNER

(75) Inventors: Timothy Griffin, Ennetbaden (CH); Frank Reiss, Lauchringen (CH); Dieter Winkler, Lauchringen (DE)

(73) Assignee: ALSTOM Technology Ltd., Baden (CH)

( * ) Notice: Subject to any disclaimer, the term of this patent is extended or adjusted under 35 U.S.C. 154(b) by 0 days.

(21) Appl. No.: 10/989,029

(22) Filed: Nov. 16, 2004

(65) Prior Publication Data

US 2005/0115244 A1 Jun. 2, 2005

Related U.S. Application Data

(63) Continuation of application No. PCT/EP03/50163, filed on May 14, 2003.

(30) Foreign Application Priority Data

May 16, 2002 (CH) ..... 2002 0830/02

(51) Int. Cl.
*F23D 14/62* (2006.01)

(52) U.S. Cl. ..... 60/737

(58) Field of Classification Search ..... 431/33, 431/350; 60/737, 738, 742
See application file for complete search history.

(56) References Cited

U.S. PATENT DOCUMENTS

| | | | | |
|---|---|---|---|---|
| 2,618,928 A | * | 11/1952 | Matthew | 60/736 |
| 4,474,014 A | * | 10/1984 | Markowski | 60/738 |
| 5,375,995 A | * | 12/1994 | Dobbeling et al. | 431/8 |
| 5,490,389 A | * | 2/1996 | Harrison et al. | 60/737 |
| 5,680,766 A | * | 10/1997 | Joshi et al. | 60/746 |
| 5,738,509 A | | 4/1998 | Marling et al. | |
| 6,098,406 A | * | 8/2000 | Bolis et al. | 60/737 |
| 6,162,049 A | | 12/2000 | Pellizzari et al. | |

FOREIGN PATENT DOCUMENTS

| | | |
|---|---|---|
| EP | 0 321 809 | 6/1989 |
| EP | 0 610 722 | 8/1994 |
| EP | 0 775 869 | 5/1997 |
| EP | 0 777 082 | 6/1997 |
| EP | 0 780 629 | 6/1997 |

(Continued)

OTHER PUBLICATIONS

Copy of Search Report for Swiss Appl. No. CH 2002 0830/02.

(Continued)

*Primary Examiner*—Ehud Gartenberg
(74) *Attorney, Agent, or Firm*—Cermak & Kenealy, LLP; Adam J. Cermak

(57) ABSTRACT

A premix burner includes a swirler (7) for a combustion air stream and a device for injection of fuel into the combustion air stream. The swirler (7) includes one or more inlet openings for combustion air of the combustion air stream entering the burner. The device for injection of fuel into the combustion air stream includes one or more first fuel lines (8) with first fuel injection openings (4). The opening diameter and/or the injection angle of the injection openings varies with respect to the axial and/or radial direction. Alternatively or in addition, some of the first fuel injection openings (4) may be arranged in one or more first groups of closely grouped fuel injection openings (4) so that each of the first groups forms one fuel jet with a large cross section. An improved mixing of the fuel with the combustion air is achieved with the burner in particular in cases in which the fuel is injected at the end of the burner facing the combustion chamber.

27 Claims, 7 Drawing Sheets

FOREIGN PATENT DOCUMENTS

| | | |
|---|---|---|
| EP | 0 924 463 | 6/1999 |
| EP | 0 981 019 | 2/2000 |
| EP | 1 070 915 | 1/2001 |
| EP | 1 070 950 | 1/2001 |
| WO | 93/17279 | 9/1993 |
| WO | 01/96785 | 12/2001 |

OTHER PUBLICATIONS

Copy of International Search Report for PCT Appl. No. PCT/EP03/50163.

Copy of International Preliminary Examination Report for PCT Appl. No. PCT/EP03/50163.

* cited by examiner

PREMIX BURNER

This application is a Continuation of, and claims priority under 35 U.S.C. § 120 to, International application number PCT/EP03/50163, "Vormischbrenner", filed 14 May 2003 by the inventors hereof, and claims priority under 35 U.S.C. § 119 to Swiss application number 2002 0830/02, filed 16 May 2002, the entireties of both of which are incorporated by reference herein.

BACKGROUND OF THE INVENTION

1. Field of the Invention

The present invention relates to a premix burner for operation in a combustion chamber, preferably in combustion chambers of gas turbines.

An exemplary field of application for a burner of this type is in the gas and steam turbine construction.

2. Brief Description of the Related Art

From patent document EP 0 321 809 B1, a conical burner is known that consists of a plurality of shells, a so-called double-cone burner. The conical swirler, which is composed of a plurality of shells, creates a closed swirling flow in a swirl chamber which, due to the swirl increasing in the direction of the combustion chamber, becomes unstable and transitions into an annular swirling flow with a backflow in the center. The shells of the swirler are assembled such that tangential air inlet slots for combustion air are formed along the burner axis. Along the inlet flow edge of the conical shells at these air inlet openings, feed lines for the premix gas, i.e., the gaseous fuel, are provided, which incorporate injection openings for the premix gas that are distributed along the direction of the burner axis. The gas is injected through the injection openings or bores crosswise to the air inlet slot. This injection process, in combination with the swirl of the combustion-air-fuel-gas generated in the swirl chamber, results in a good mixing of the premix fuel with the combustion air. In premix burners of this type a good mixing is the precondition for low $NO_x$ values during the combustion process.

To further improve a burner of this type, a burner for a heat generator is known from patent document EP 0 780 629 A2, which incorporates an additional mixing path following the swirler, for an additional mixing of the fuel and combustion air. This mixing path may be implemented, for example, in the form of a downstream tube section, into which the flow emerging from the swirler is transferred without any significant flow losses. With the aid of the additional mixing path the degree of mixing can be increased further and the pollutant emissions reduced accordingly.

Patent document WO 93/17279 shows an additional known premix burner, wherein a cylindrical swirler with a conical inner body is used. In this burner the premix gas is also injected into the swirl chamber via supply lines with corresponding injection openings that are arranged along the air inlet slots that extend in an axial direction. The burner additionally incorporates in its conical inner body a central feed line for burnable gas, which can be injected near the burner port into the swirl chamber for piloting. The additional pilot stage serves for the start-up of the burner, as well as to expand the operating range. In the so-called pilot operation, which incidentally also belongs to the generally known prior art for other premix-type burners, the fuel is injected in such a way—for example in the form of a gas jet that is injected along the burner axis—that it does not mix with the combustion air prior to the combustion process.

This generates a diffusion flame which, even though it does result in higher pollutant emissions on the one hand, also has a significantly wider stable operating range on the other hand.

From patent document EP 1 070 915 A1, a premix burner is known wherein the burnable gas supply is mechanically decoupled from the swirler. This prevents tensions from thermal expansions when fuel gases are used that are not prewarmed or only slightly prewarmed. The swirler in this case is provided with a series of openings through which the fuel lines for the gas premix operation, which are mechanically decoupled from the swirler, extend into the interior of the swirler where they supply gaseous fuel to the swirling flow of the combustion air.

These known premix burners of the prior art are so-called swirl-stabilized premix burners, wherein a flow of a fuel mass is distributed as homogeneously as possible in a combustion-air mass flow prior to the combustion. The combustion air in these burner types flows into the swirlers via tangential air inlet slots. The fuel, particularly natural gas, is typically injected along the air inlet slots.

In gas turbines, synthetically produced gases, so-called Mbtu and Lbtu gases, are also used for combustion besides natural gas and liquid fuel, usually diesel oil or Oil#2. These synthesis gases are produced by gasifying coal or oil residues. They are characterized in that they largely consist of $H_2$ and CO. Added to this is a smaller percentage of inert gases, such as $N_2$ or $CO_2$.

When synthesis gas is used for the combustion, the injection process that has proven effective for natural gas in the burners of the prior art can no longer be used because of a high danger of flashbacks.

The following particularities and requirements exist, in contrast to the use of natural gas, for a burner that is to be operated with synthesis gas. Synthesis gas requires a fuel volume flow that is approximately four times higher in dependence upon a dilution of the synthesis gas, which is known per se from the prior art—and in the case of undiluted synthesis gas even seven times higher or more—compared with comparable natural gas burners, so that noticeably different impulse conditions result with the same gas supply perforations of the burner. Due to the high content of hydrogen in the synthesis gas and the related low ignition temperature and high flame speed of the hydrogen, the fuel has a high propensity to react so that especially the flashback behavior and retention time of ignitable fuel-air mixture in the vicinity of the burner must be examined. Additionally, a stable and safe combustion of synthesis gases must be ensured for a sufficiently large range of heating values, which is composed differently depending on the process quality of the gasification and on the starting product, e.g., oil residues in the synthesis gas. In order to still be able under these conditions to attain a premixing and, along with it, the typical low emissions during the combustion process, these synthesis gases are usually diluted with inert gases, such as $N_2$ or water vapor prior to their combustion. This reduces particularly the flashback danger that is immanent due to the high $H_2$ content. The burner must thus be able to burn, in a safe and stable manner, synthesis gases of different compositions, especially different degrees of dilution, and the resulting significantly variable fuel volume flows.

Additionally it is advantageous if the burner can also safely burn a backup fuel in addition to the synthetic fuel. In the highly complex integrated gasification combined cycle (IGCC) systems, this requirement results from the demand for a high degree of availability. The burner should function safely and reliably in such a case also in a mixed operation of synthesis gas and backup fuel, for example diesel fuel, for which process the fuel mix spectrum for a single burner that can be used for the burner operation in a mixed operation must be maximized. Low emissions, typically $NO_x \leqq 25$ vppm and $CO \leqq 5$ vppm, should, of course, be ensured for the specified and utilized types of fuel.

From patent document EP 0610 722 A1, a double-cone burner is known wherein a group of fuel injection openings for a synthesis gas are arranged on the swirler, distributed about the circumference of the burner at an end of the burner facing the combustion chamber. These injection openings are supplied via a separate fuel line and make it possible for the burner to be operated with undiluted synthesis gas.

However, this fuel injection at the combustion-chamber end of the burner can result in an insufficient mixing of the fuel with the swirling flow of the combustion air since the retention time of the fuel in the swirling flow prior to reaching the flame stabilizing zone (vortex recirculation zone) is short.

An additional problem arises with the above burners of the prior art if they are designed for the injection of a fuel with low to medium heating value, or if they are operated with such a fuel. Fuels with low to medium heating value must be injected into the swirling flow at high volume flows in order to achieve sufficient heat generation during the combustion. However, the high volume flows of the fuel disturb the swirling flow forming in the burner so that, in extreme cases, this can result in the flame-stabilizing recirculation zone failing to materialize.

SUMMARY OF THE INVENTION

With the above described prior art as the starting point, one of numerous aspects of the present invention includes a premix burner wherein the shortcomings of the prior art do not occur and which ensures an improved mixing with the combustion air especially when operated with synthesis gas or with a fuel with low to medium heating value.

Advantageous embodiments of burners incorporating principles of the present invention can be gathered from the description below and from the example embodiments.

One aspect of the present invention includes a burner having a swirler for a combustion air stream and means for injection of fuel into the combustion air stream. The term injection shall be understood in this context to mean the feeding of fuel via an injection opening in such a way that preferably a directed fuel jet of random geometry is generated. The swirler incorporates combustion air inlet openings for the combustion air stream, which preferably enters the burner tangentially. The means for injection of fuel into the combustion air stream comprise one or more first fuel lines with first fuel injection openings. Depending on the design of the burner, these fuel injection openings may be arranged for example distributed about the circumference of the burner in one or more planes perpendicular to the longitudinal burner axis, i.e., to the axial direction, or along the first fuel lines on the outer shell of the burner or on an inner body inside the burner. The first fuel injection openings in the present burner are formed in such a way that the opening diameter of these first fuel injection openings and/or an injection angle of the first fuel injection openings with respect to the axial and/or radial direction varies along the first fuel lines and/or about the circumference of the burner. In an alternative design, at least some of the first fuel injection openings are arranged in such a way in one or more first groups of closely spaced fuel injection openings that each of the first groups generates a fuel jet with a large cross section—relative to a fuel jet formed by a single fuel injection opening. Each group then has an effect equivalent to a fuel injection opening with a correspondingly larger opening diameter.

The exemplary embodiment of the fuel injection openings with opening diameters and/or axial and/or radial injection angles that vary about the circumference and/or along the axial extension of the burner, achieves an improved mixing of the injected fuel with the combustion air that forms the swirling flow. The varying opening diameters and/or injection angles affect varying penetration depths of the fuel into the inner volume or swirling flow of the burner. This allows the fuel to be distributed more evenly over the combustion air. Additionally, the varying penetration depths of the fuel jets exiting from the fuel injection openings result in a reduced disturbance of the swirling flow since no continuous fuel wall can form, as can be the case with high fuel volume flows and identically designed fuel injection openings of the prior art. The swirling flow that forms inside the burner can be additionally enhanced with an appropriate selection of the injection angles.

In an alternative embodiment of the present burner, wherein at least a portion of the first fuel injection openings are arranged in individual groups of closely spaced fuel injection openings, a single large-diameter fuel jet is created by the given fuel injection openings of a single group, which has a greater penetration depth than the fuel jet of a single injection opening. For this, the fuel injection openings of the individual groups must be located sufficiently close together so that they form a common fuel jet, resulting in each group having an effect equivalent to a fuel injection opening with a correspondingly larger opening diameter. Due to the greater penetration depth of this common fuel jet, this design, too, results in a variation of the penetration depths of the fuel over the circumference and/or axial extension of the burner, thus resulting in an improved mixing of the fuel and combustion air. This alternative design of the burner can, of course, also be combined in any desired manner with the design of the fuel injection openings with varying injection angles and opening diameters. The different injection angles may be achieved in this context in a known manner by means of different orientations of the injection channels in the fuel lines that form the fuel injection openings.

The opening diameters or injection angles preferably alternate about the burner circumference or along the fuel lines between at least two values, so that a larger and a smaller injection angle, or a larger and a smaller opening diameter of the fuel injection openings that are arranged in this direction, alternate in each case about the circumference or along the longitudinal direction of the burner. If there are more than two different values of the opening diameter and/or injection angle, the corresponding variation is accomplished preferably by means of a periodic repetition of the different opening diameters or injection angles about the circumference or along the longitudinal direction of the burner. With a concomitant variation of the opening diameter and injection angle relative to the axial direction in the case of a fuel injection opening with a larger injection angle, a larger opening diameter is preferably selected than for a fuel injection opening having a smaller injection angle.

In the case of a variation of the injection angles relative to the radial direction, these injection angles of the fuel injection openings are selected such that fuel jets from different groups of injection openings that exit from the fuel injection openings intersect in each case in different points outside the central longitudinal burner axis in the inner volume of the burner.

In an advantageous aspect of the present burner, the first fuel injection openings are distributed at an end of the burner facing the combustion chamber, i.e., at the burner port, about the circumference of the burner. The one or more first fuel lines with the first fuel injection openings are preferably mechanically decoupled in this case from the swirler.

The geometry of the swirler, as well as that of an optionally present swirl chamber, may be selected in different ways in the present burner and incorporate particularly the geometries known from the prior art. The preferred distribution of the first fuel injection openings about the circumference of the burner exclusively at the end of the burner or swirl chamber facing the combustion chamber reliably prevents flashbacks of injected synthesis gas. However, a mixing with the combustion air exiting from the burner is still ensured to a sufficient degree. Synthesis gas with high hydrogen content (45 vol %) may be combusted undiluted (lower heating value LHV≈14000 kJ/kg). The burner can, of course, also be operated with synthesis gas of a different hydrogen content, for example with $H_2$≈33%. The burner, in this design, thus permits a safe and stable combustion of both undiluted as well as diluted synthesis gas. This guarantees a high degree of flexibility when a gas turbine that is equipped with inventive burners is used in an IGCC process. With a design of the first fuel lines(s) with an appropriately adapted diameter, high volume flows up to a factor of 7, as compared to the injection of natural gas in known burners of the prior art, may be safely fed to the injection point at the burner port.

In an exemplary burner incorporating principles of the present invention, the one or more first fuel lines with the associated first fuel injection openings are preferably mechanically and thermally decoupled from the swirler or burner shells that form the swirler and which are considerably warmer during the operation. In this manner both components can thus perform thermal expansions and especially differential expansions independently from one another and without interfering with one other. In this manner the thermal tensions between the comparably cold first fuel lines, which will also be referred to as gas channels below, and the warmer burner shells are thus prevented or at least considerably reduced. In one embodiment of the present burner, which will be explained in more detail in conjunction with the examples, the injection region for the synthesis gas in the burner shells is completely cut out, for example. The first gas channel is anchored directly in this cutout of the burner shells. The gas channel and burner shells are thus thermally and mechanically decoupled from one another and the design problem at the connecting points of the cold gas channel and warm burner shell is solved. Earlier designs, such as that in patent document EP 0610 722 A1, have revealed problems or cracks, especially at the connection of the relative cold gas channel to the hot burner shell, due to the high tension concentration at these connecting points. With the decoupled solution and the presented design, the burner achieves its required serviceable life.

The decoupling of individual burner lances from the burner shells is already known from patent document EP 1 070 915. In an advantageous embodiment of the present burner, however, this mechanical decoupling is implemented for the first time with integral gas channels with a circumference-homogenous gas injection. As compared to the gas injection known from patent document EP 1 070 950, this circumference-homogenous gas injection captivates with a significantly more even distribution of the fuel in the combustion air and thus, especially when Lbtu and Mbtu fuels are used, with a superior emission behavior while at the same time providing a good flame stability. A complex special heat insulation of the gas channel relative to the hot burner shell—for example by means of the gas channel insert that is known per se to those of ordinary skill in the art—is not necessary.

Especially in a burner in which the first fuel injection openings are arranged distributed about the circumference of the burner at the end of the burner facing the combustion chamber, a significantly improved mixing of the fuel with the combustion air can be attained with the present variation of the injection angle or injection depth.

However, an improved mixing effect, as well as a reduced disturbance of the swirling flow can, of course, also be implemented in burners in which the first fuel lines with the first fuel injection openings are arranged in the longitudinal direction of the burner along its outer shell or outer shells.

In an additional embodiment the burner has, in addition to the first fuel line or lines, also one or more second fuel lines with a group of second fuel injection openings on the swirler body that are essentially arranged along the direction of the burner axis. Alternatively or in combination therewith, a burner lance, which is essentially arranged on the burner axis and which extends in an axial direction into the combustion chamber, may also be provided for the injection of liquid fuel or pilot gas for a diffusion combustion. The arrangement and design of these additional fuel lines may be based, for example, on the known premix burner technology according to patent document EP 321 809, or also other design types, for example, according to patent documents EP 780 629 or WO 93/17279. Burner geometries of these types may be implemented with the inventive characteristics for the embodiment and arrangement of the first fuel injection openings.

With this embodiment of the present burner with one or more additional fuel lines, a multifunctional burner is attained that burns the most varied types of fuel in a safe and stable manner. The burner can ensure particularly the stable and safe combustion of Mbtu synthesis gases (minimum $H_2$ content=10 vol %) with heating values (lower heating value LHV) of 3500–18000 kJ/kg, especially 6000 to 15000 kJ/kg, preferably from 6500 to 14500 kJ/kg or from 7000 to 14000 kg/kJ. In addition to the safe and stable combustion of undiluted and diluted synthesis gas with the appropriate arrangement of the first fuel injection openings at the end of the burner facing the combustion chamber, liquid fuel, for example diesel oil, may also be used as a backup fuel. The utilized types of fuel may have significant differences in their heating value, for example diesel oil with a heating value LHV=42000 kJ/kg and synthesis gas with a heating value of 3500–18000 kJ/kg, especially 6000 to 15000 kJ/kg, preferably from 6500 to 14500 kJ/kg or from 7000 to 14000 kg/kJ.

The use of natural gas as an additional fuel is possible as well. The injection of natural gas may optionally take place in this case either in the burner head through the burner lance and/or via the second fuel lines, which are usually formed by the gas channels that are mounted in a longitudinal direction at the air inlet slots on the swirler or swirler body and which are known to the person of ordinary skill in the art for example from patent document EP 321 809. In this manner the burner can be operated with three different types of fuel.

For the combustion of synthesis gas, the first fuel lines are additionally adapted in their design to the up to 7 times greater fuel volume flow and they make available particularly the required volume flow cross sections. In these cases they have a cross section that is a multiple of that of the feed lines for natural gas.

When oil is used as the fuel, the injection of the oil or of an oil-water-emulsion via a burner lance that is known from the prior art is maintained. Due to various fringe conditions, such as the incorporation of the gas turbine into the IGCC process, or fixed burner groupings that must be maintained, gas turbines that burn synthesis gas must guarantee a mixed operation of ignition fuel and synthesis gas. The burner that is described here also functions in a stable and safe manner in a mixed operation of diesel oil and synthesis gas in various mixture ratios. It can safely be operated in a mixed operation for extended periods of time. The gas turbine thus attains additional flexibility and can switch in its operation from one type of fuel to the other. The possibility of a mixed operation represents a significant operational advantage.

BRIEF DESCRIPTION OF THE DRAWINGS

The present invention will be explained again briefly below, without limiting the general inventive concept, with the aid of embodiments in conjunction with the figures, in which.

DETAILED DESCRIPTION OF THE EXEMPLARY EMBODIMENTS

Figure 1:
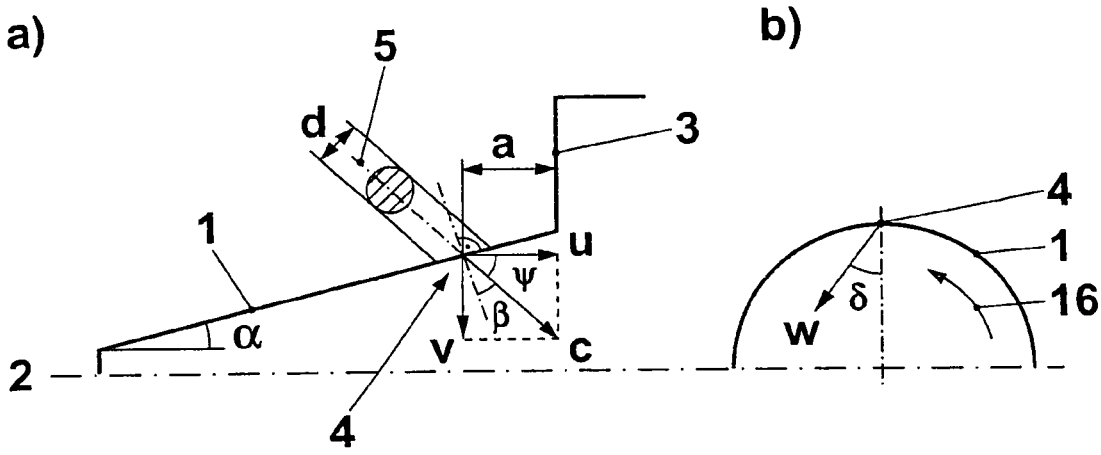
FIG. 1 shows a schematic rendering of some of the parameters of the injection openings that are influenced in the present burner.

FIG. 1 shows different parameters in the design of fuel injection openings for illustration purposes, which play a role in the implementation of the present burner. In the figure, a portion of a burner is shown schematically in a sectional view in Partial View a), wherein the burner shell 1, a central longitudinal burner axis 2, as well as a front panel 3 provided at the end of the burner facing the combustion chamber can be seen. Over the circumference of the burner shell 1, fuel injection openings 4 are arranged in this example that have the opening diameter d, as well as a uniform distance a to the front panel 3. The burner shell 1, in this example, has an incline $\alpha=11°$ relative to the axial direction which is established by the longitudinal burner axis 2. The fuel injection openings 4 are implemented as injection channels, the channel axis 5 of which extends at a certain angle to the axial and radial direction of the burner. The course of the channel is illustrated in this figure by the laterally extended lines in which the opening cross section has been indicated by a hatched area. The direction of the injection channel axis 5 relative to the axial and radial direction of the burner determines the injection direction of the fuel into the interior space of the burner. In the figure, the velocity vector c of the injection can be seen, as well as its corresponding components in the axial direction (u) and radial direction (v). The injection angle relative to the axial direction is denoted with $\psi$, the angle relative to the perpendicular direction to the burner wall or burner shell 1 is denoted with $\beta$. Typical values for the angle $\beta$ are 20°, 30° or 40°.

The Partial View b) additionally shows a top view on a burner according to Partial View a). In this Figure b), the velocity component w of the fuel jet that is injected through the fuel inlet opening 4 is visible, which is not visible in Partial View a). This velocity component has an angle $\delta$ relative to the radial direction of the burner. In the present example, the injection takes place in the same direction as the swirl direction 6 of the combustion air entering into the burner, as can be seen from the partial view.

In the present burner, the parameters illustrated in FIG. 1, i.e., the injection angle $\psi$ relative to the axial direction, the injection angle $\delta$ relative to the radial direction, as well as the opening diameter d of the fuel injection openings are now varied in the circumferential direction of the burner and/or along the fuel lines, so that different groups of fuel injection openings have different injection angles $\delta$ or $\psi$ and/or different opening diameters d.

The opening diameter d, the distance between the individual injection openings, the impulse ratio between the fuel and combustion air, as well as the injection direction have an influence on the penetration depth of the fuel jet into the burner or swirling flow within the burner. This penetration depth is proportional to $J^a \times d^b \times \sin\psi$, wherein a and b are positive exponents, J is the impulse ratio between the fuel and combustion air, and d is the diameter of the fuel injection openings.

From this relationship it is apparent that an increase in the fuel injection impulse has a significant influence on the penetration depth. There is a limit, however, to the fuel pressure that is available in a fuel system. The opening diameter of the fuel injection openings also has an influence on the penetration depth, however, it is also limited. In particular, an overly large opening diameter can negatively influence the reliability of the fuel system during partial-load operation, as well as during an operation with burnable oil operating. This applies particularly to the thermo-acoustical stability of the overall system.

Figure 2:
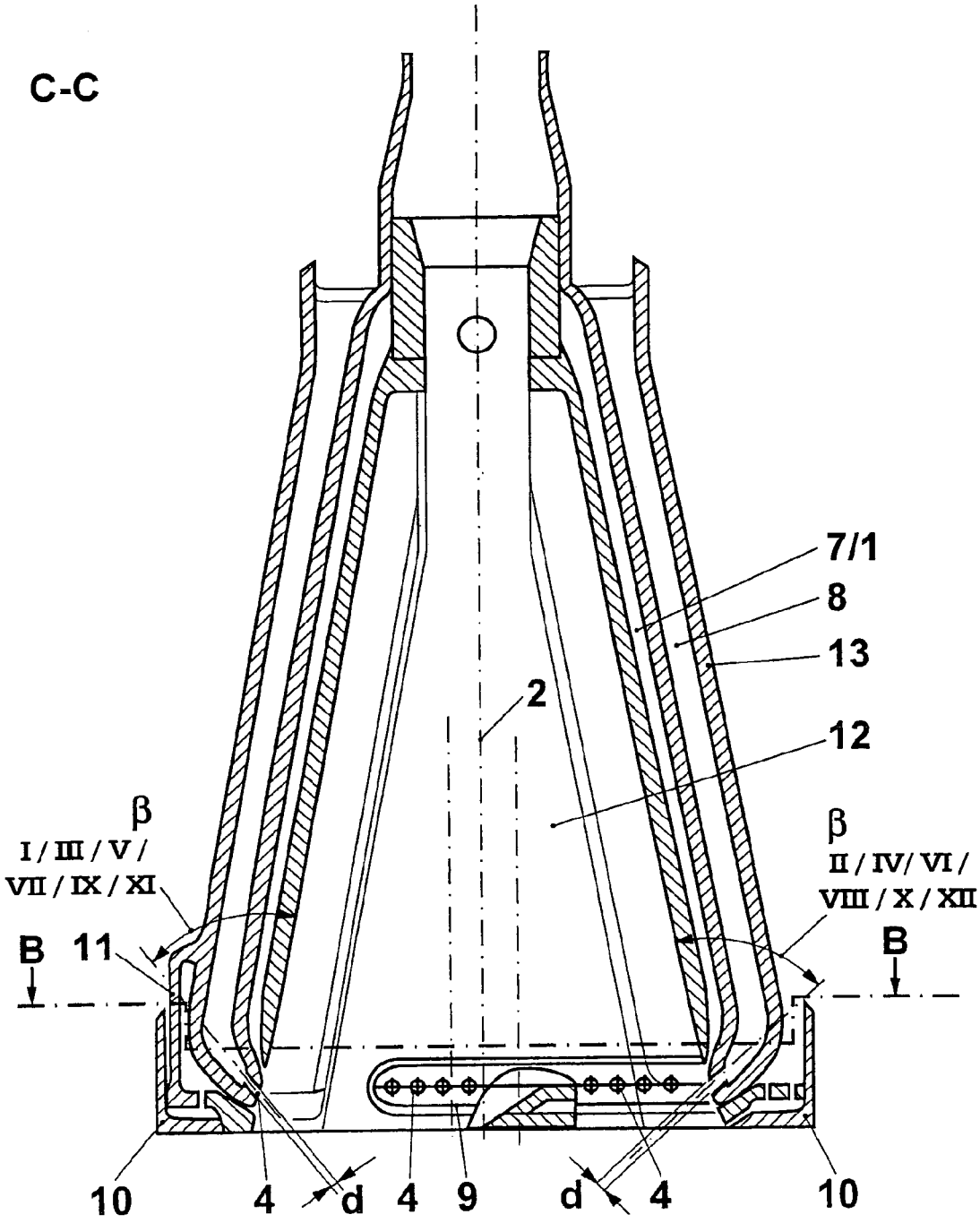
FIG. 2 shows a sectional view of an embodiment of the present burner.

FIG. 2 shows an example of a design of a burner with first fuel lines and fuel injection openings that may be formed according to the present invention. In this embodiment of a burner, which is suitable in particular for the injection of synthesis gas, first fuel injection openings 4 are arranged radially at the burner port, i.e., at the end of the inner volume 12 of the burner that forms the swirl chamber, distributed about the circumference of the burner in one row. Because of this injection at the burner port, combustion of the hydrogen-rich synthesis gas becomes possible also undiluted. The figure, in this context, shows the burner shells 1 which, in this example, form the swirler 7 by means of their conical-shell type design. Disposed outside of this swirler 7 is a gas supply element 13, which radially encompasses the swirler 7 and forms the first fuel line or lines 8 for the supply of synthesis gas. At the end of this gas supply element 13 that faces the combustion chamber, the first fuel injection openings 4 for the synthesis gas are arranged. These injection openings 4 form injection channels, which determine the injection direction for the synthesis gas. The injection angles $\psi$ shown in this example relative to the axial direction and/or the diameter d of these channels or openings 4 vary in the present burner, as can bee seen, for example, from FIGS. 4–6 below.

In the present example, altogether 12 first fuel injection openings 4 are arranged side by side, evenly distributed about the circumference of the burner, which are denoted with the roman numerals I–XII. The odd-numbered injection openings 4 in this case have an injection angle ψ relative to the axial direction of approximately 50° (60° to the burner shell), whereas the odd-numbered injection openings 4 have an injection angle of approximately 40° relative to the axial direction (50° to the burner shell).

The comparatively cold fuel channels 8 for injecting the synthesis gas, and the burner shells 1 that are significantly warmer in principle, are thermally and mechanically decoupled from one another in this example. This significantly reduces the thermal tensions. The connection between the gas supply element 13 and swirler 7 is made via straps 10 or 11 that are provided on both elements and which are connected to one another. In this manner, minimal thermal tensions are achieved. In the figure, an opening or circumferential gap 9 is also visible on the swirler 7, which is necessary to permit a connection between the injection openings 4 of the gas supply element 13 and the swirl chamber 12.

In the present example the injection region for the fuel is completely cut out in the burner shells. The gas supply element 13 is anchored directly into this cutout in the burner shells 1 or swirler 7. This solves the problem of tensions at the connecting points of the cold gas supply element 13 and warm burner shell. The swirler 7 itself is preferably formed of at least two partial shells with tangential air inlet slots, as this is known, for example, from patent document EP 0 321 809 B1.

FIG. 3 again shows the burner of FIG. 2 along the section line B—B. In this figure, the two partial shells of the swirler 7 with the tangential air inlet slots 14 and fuel lines 8 of the gas supply element 13 are clearly visible. In these fuel lines 8, the 12 fuel injection openings 4 have been indicated in each case. The burner is encompassed by a housing 15. The gas supply element 13 may be designed as an annular supply slot for forming a single fuel injection channel 8 on one hand or it may also be divided into separate fuel supply channels. It is also possible, of course, to route individual supply lines as fuel channels 8 to the injection openings 4.

The fuel supply channels 8 are adapted, for the supply of synthesis gas, to the up to seven times larger fuel volume flow compared to conventional types of fuel and make available particularly the necessary large flow cross sections.

In a burner of this type, additional gas injection channels may, of course, also be arranged along the air inlet slots 14, as this is the case in the known burner geometries of the prior art, for example the above-mentioned patent document EP 0 321 809 B1. Via these additional fuel supply channels, customary fuel can be injected into the inner volume 12 in addition or alternatively to the synthesis gas.

Figure 3:
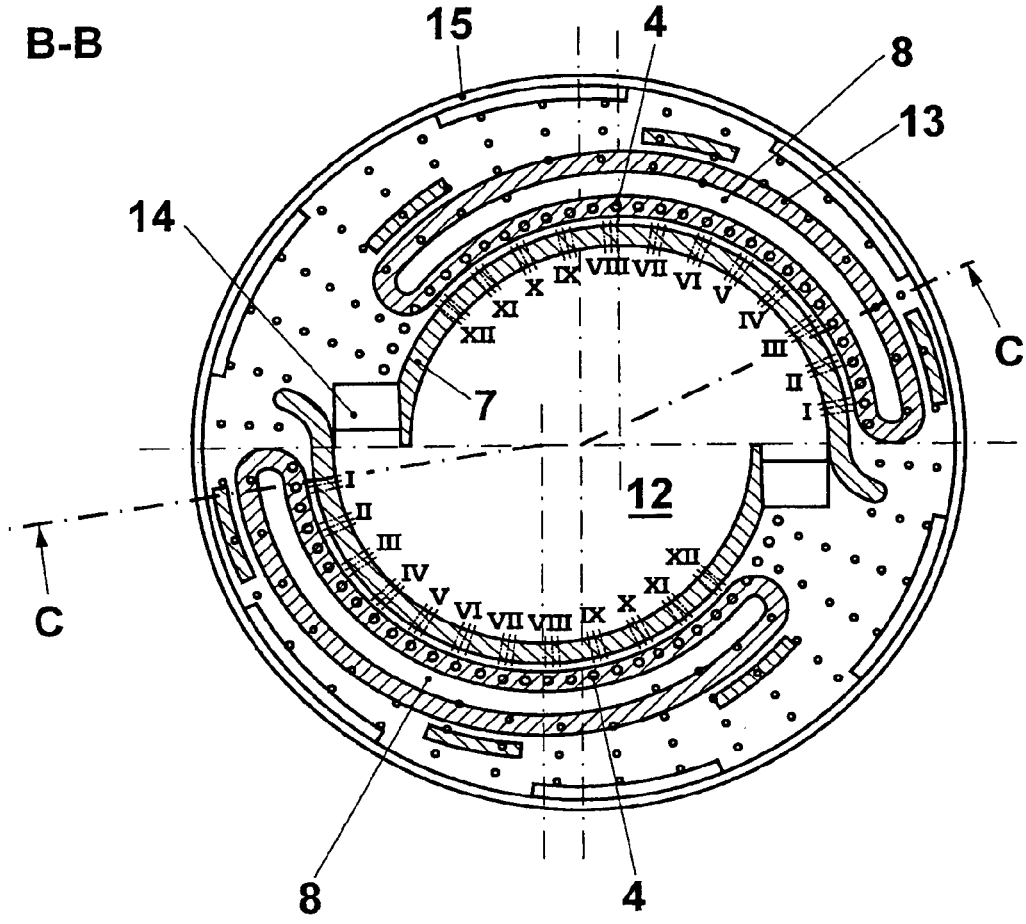
FIG. 3 shows a sectional view through the plane B—B of the burner in FIG. 2.
Figure 4A:
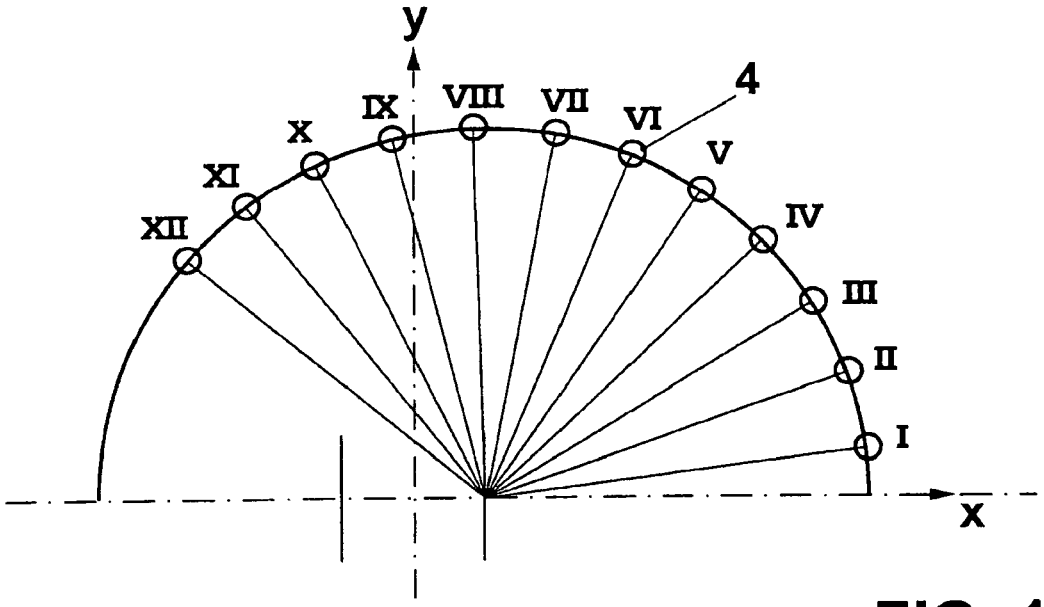
FIG. 4 shows an illustrative presentation of different injection angles relative to the axial direction.
Figure 4B:
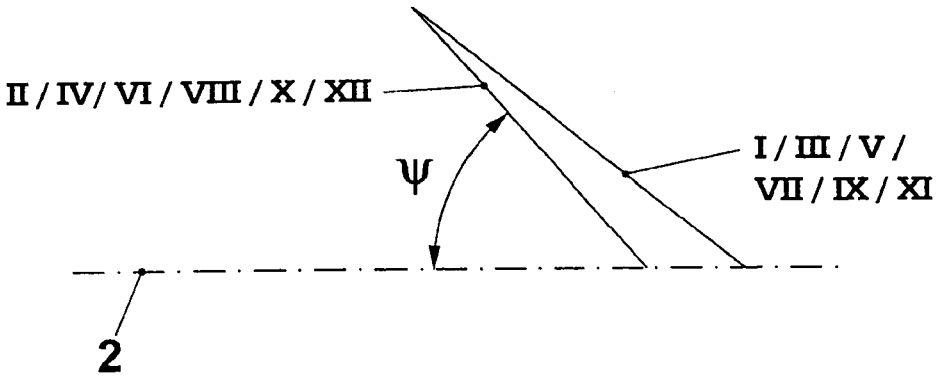

FIG. 4 schematically shows the direction of injection of the fuel injection openings 4 of a burner like the one in FIGS. 2 and 3 according to an embodiment of the present invention. In Partial View a), one half of the burner is shown in a top view with the fuel injection openings 4 arranged distributed about the circumference. The injection direction of the twelve shown injection openings 4 relative to the radial direction is δ=0°, which means that all fuel jets exiting from the injection openings are directed towards the central longitudinal axis of the burner, as illustrated with the lines shown in the figure.

From Partial View b), the injection angle ψ relative to the axial direction of the burner becomes apparent, which alternates between two values in this example, and which takes the values ψ=40° and ψ=50°. All even-numbered fuel injection openings (II/IV/VI/III/X/XII) have the injection angle of 50°, all odd-numbered injection openings 4 (I/III/V/VII/IX/XI) have the smaller injection angle ψ=40°. With this variation of the injection angle ψ over the circumference of the burner, the local mixing of the injected fuel with the combustion air is improved due to the different penetration depths of the fuel jets. The overlap of the individual fuel jets is reduced so that the fuel is distributed better within the swirling flow.

An improved distribution can also be achieved with a variation of the opening diameters d of the individual fuel injection openings 4. These may alternate, for example, between two values in the same manner as the injection angles in FIG. 4, so that every second injection opening has the same opening diameter. These different opening diameters also alter the penetration depth of the fuel jet, so that an improved distribution and mixing of the fuel with the combustion air is achieved. The variation of the opening diameter can, of course, be combined at any time with the variation of the injection angles. In this case a larger opening diameter is preferably combined with a larger injection angle.

Figure 5:
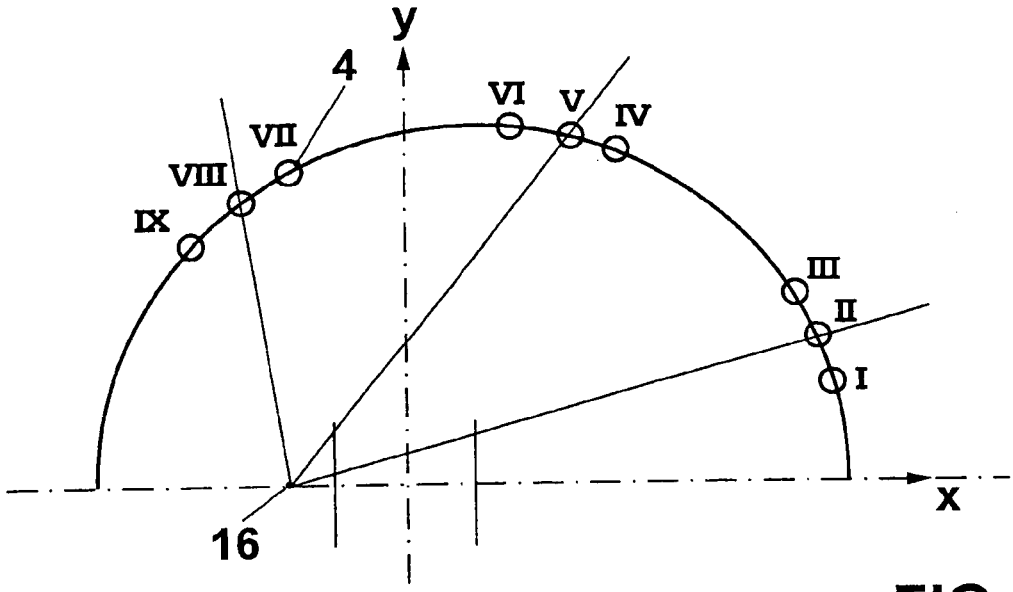
FIG. 5 shows an example for the formation of individual groups of injection openings for generating a fuel jet with a large jet diameter.

FIG. 5 shows an additional embodiment of the injection in a burner according to the present invention. This figure, too, is a schematic rendition of one half of a burner according to FIGS. 2 and 3 in a top view, with nine injection openings 4 being visible in this example. Three of these injection openings 4 are grouped close together in each case, so that altogether 6 groups of injection openings are formed over the entire circumference of the burner, three of which are shown in the figure. With this grouping of the injection openings 4, the individual jets that initially exit from the injection openings 4 of one group combine to form a combined jet which, due to this confluence has a greater jet diameter with greater penetration depth. This grouping also makes it possible to locally increase the penetration depth of the fuel into the inner space 12 of the burner or swirling flow.

In FIG. 5, different injection angles δ of the individual groups of injection openings have additionally been selected here relative to the radial direction, which intersect in a point 16 outside the longitudinal burner axis 2.

In addition to these groups of fuel injection openings, ungrouped injection openings may, of course, also be provided, through which additional fuel jets with a smaller jet diameter are injected. A combination with different injection angles ψ relative to the axial direction and/or different opening diameters of the individual fuel injection openings is also possible, of course. For example, grouped injection openings may have larger opening diameters than ungrouped injection openings, or the opening diameters of the injection openings may vary from group to group.

Figure 6:
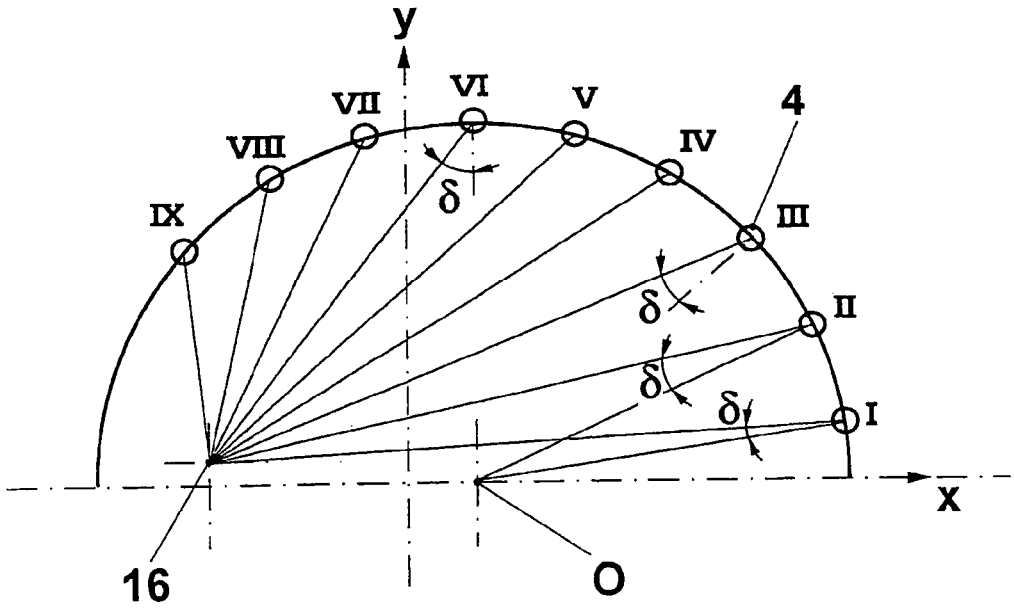
FIG. 6 shows an example for the variation of the injection angle relative to the radial direction.

FIG. 6 shows an additional example for a fuel injection with a burner according to the present invention. In this example the injection angle δ varies about the burner circumference relative to the radial direction of the burner, so that the injection directions intersect in a point 16 far outside the longitudinal burner axis 2. If the fuel is injected in the same direction as the swirl of the combustion air forming in the inner volume 12, a greater penetration depth results in this case than with an injection in the opposite direction.

This injection angle δ may thus also be used to attain an improved distribution of the fuel within the swirling flow. Injecting in the same direction as the direction of the swirling flow can additionally strengthen this flow, so that the flame stabilization process can be enhanced in this manner. This variation of the injection angle δ relative to the radial direction, too, can be combined with the above-explained examples. It is also possible, of course, to design individual groups of fuel injection openings with respect to their injection angles δ in such a way that their injection directions form different intersecting points 16 within the inner volume of the burner.

It goes without saying that the number of fuel injection openings 4 shown in the above examples may be chosen as desired depending on the requirement. Likewise, a plurality of rows of fuel injection openings 4 may be provided as well, which may be designed according to the above examples.

Figure 7A:
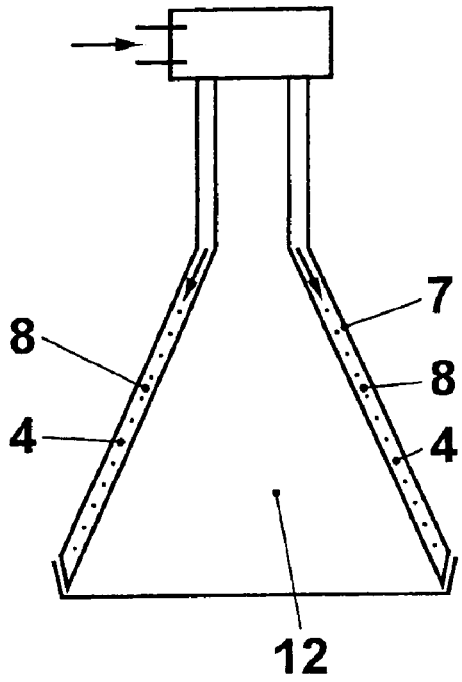
FIG. 7 shows a significantly schematized example for a burner having fuel injection openings arranged along the longitudinal extension of the burner, as well as examples for the design of the fuel injection openings.
Figure 7B:
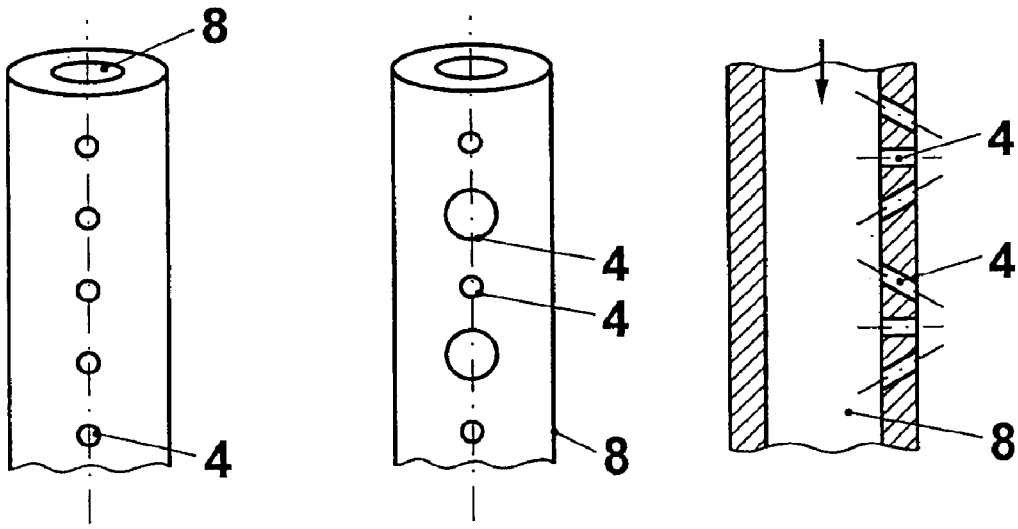

If the fuel is injected via fuel injection openings that are arranged in an axial direction of the burner shells, they can also be designed according to the above examples. This is apparent by way of an example from FIG. 7 which, in Partial View a) shows a known burner geometry with the swirler 7, as well as the fuel lines 8 arranged on the swirler 7 with corresponding fuel injection openings 4. The fuel injection openings 4 of the individual fuel lines 8 may be designed, for example, with different opening diameters according to Partial View b), in order to attain different penetration depths. In an additional embodiment, the channel axes of the injection channels of these injection openings 4 may form different angles, both relative to the radial as well as to the axial direction of the burner. Designs of this type can thus be used to attain the same effects as explained in conjunction with the above figures.

Even though the invention was presented mainly in conjunction with a double-cone burner of a type known from patent document EP 0 321 809 B1, the person of ordinary skill in the art will easily recognize the applicability of the invention also for other burner types and swirler geometries, as they are known, for example, from patent documents EP 780 629 or WO 93/17279. Modified versions of these burner geometries are also possible, of course, as long as the inventive design of the fuel injection openings can be implemented with these types of burners.

Figure 8:
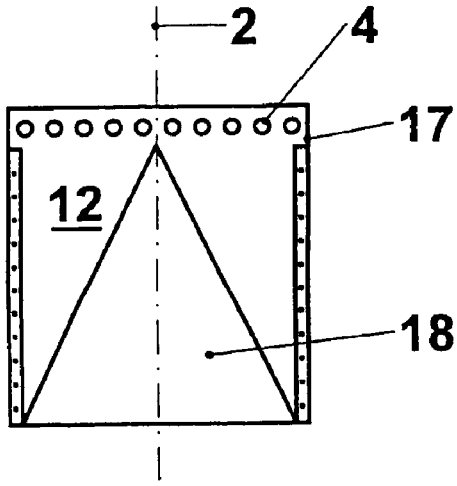
FIG. 8 shows an example for a design of the burner with a conical inner body.

FIG. 8, for example, shows an example of a swirler 7 with a purely cylindrical swirler body 17, into which a conical inner body 18 has been inserted. In this example, the injection openings 4 for synthesis gas are arranged at the end of the swirl chamber 12 facing the combustion chamber, distributed about the circumference of the burner. The fuel supply channels 8 were not drawn into this illustration. Additional gas injection openings for natural gas including the required feed lines may be provided in this case as well, in addition to the tangential air inlet slots, which are not shown here.

Figure 9:
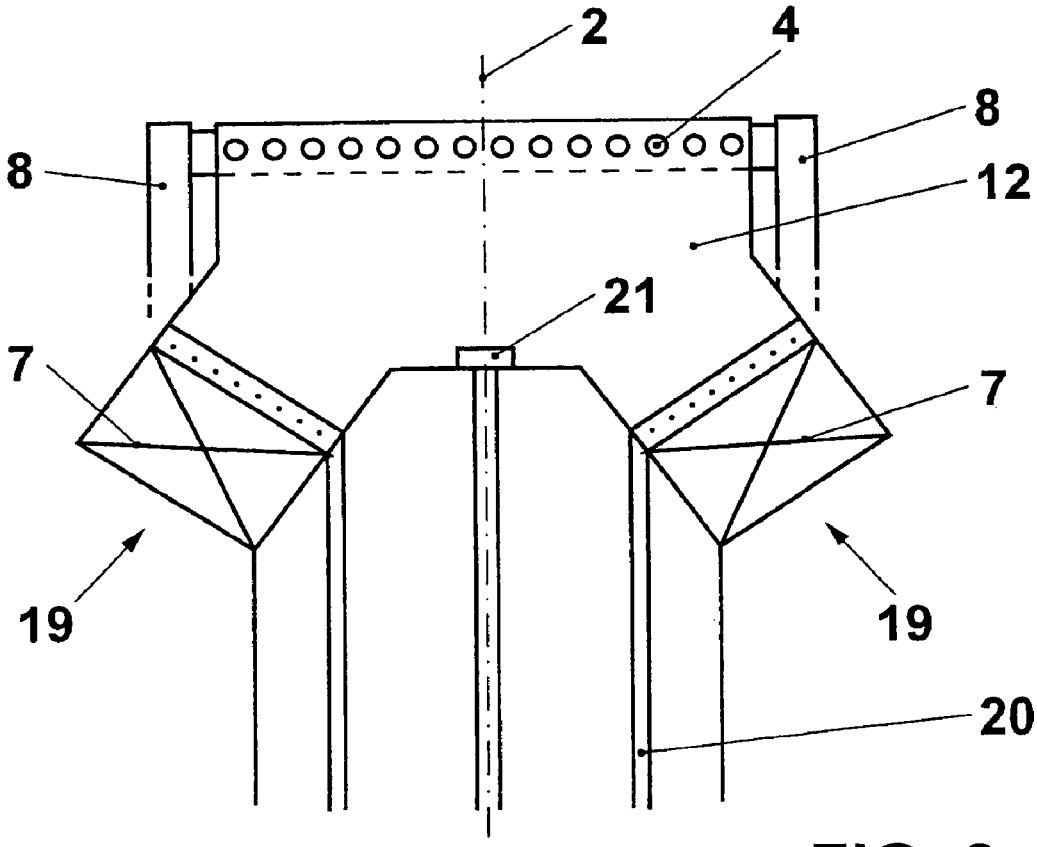
FIG. 9 shows an example for an additional possible design of the burner.

An additional example of a burner in which the swirler 7 is designed as a swirler grid whereby entering combustion air 19 is caused to swirl, is presented schematically in FIG. 9. Additional fuel for premix charging can be injected into the combustion air 19 via feed lines 20 that lead to injection openings in the region of the swirler 7. The supply of a pilot fuel or liquid fuel is implemented by means of a nozzle 21 that centrally projects into the inner volume 12. In this burner the injection openings 4 for the synthesis gas are also arranged distributed about the circumference of the burner at the end of the inner volume 12 facing the combustion chamber and they are injected with synthesis gas via the fuel supply channels 8. As is apparent, the same designs of the injection openings 4 can be implemented in both burner geometries of FIGS. 8 and 9 as in the burner presented in FIGS. 2 and 3.

LIST OF REFERENCE NUMERALS

1 burner shell
2 longitudinal burner axis
3 front panel
4 first fuel injection opening
5 injection channel axis
6 swirl direction
7 swirler
8 first fuel line
9 opening slot in the swirler
10 straps at the swirler
11 straps at the gas supply element
12 inner volume (swirler volume)
13 gas supply element
14 air inlet openings
15 housing
16 point of intersection
17 swirler body
18 inner body
19 combustion air
20 feed lines
21 nozzle While the invention has been described in detail with reference to exemplary embodiments thereof, it will be apparent to one skilled in the art that various changes can be made, and equivalents employed, without departing from the scope of the invention. Each of the aforementioned documents is incorporated by reference herein in its entirety.

What is claimed is:

1. A premix burner comprising:

a central longitudinal axis defining an axial direction, and a radial direction oriented towards the central longitudinal direction;

a swirler for a combustion air stream, the swirler at least one combustion air inlet opening for the combustion air stream entering into the burner;

means for injection of fuel into the combustion air stream including at least one first fuel line with first fuel injection openings arranged in a plane perpendicular to the longitudinal burner axis;

wherein the first fuel injection openings are configured and arranged so that an injection angle of the first fuel injection openings varies relative to the axial direction, relative to the radial direction, or both, about the circumference of the burner.

2. A burner comprising:

a longitudinal burner axis;

a swirler for a combustion air stream, the swirler including at least one combustion air inlet opening for the combustion air stream entering into the burner;

means for injection of fuel into the combustion air stream comprising at least one first fuel line with first fuel injection openings arranged in a plane perpendicular to the longitudinal burner axis and distributed about the circumference of the burner;

at least some of the first fuel injection openings being arranged in one or more first groups of closely spaced fuel injection openings so that each of the first groups generates a fuel jet with a large jet cross section.

3. A burner according to claim 1, wherein at least some of the first fuel injection openings are arranged in at least one first group of closely spaced fuel injection openings so that each of the at least one first group generates a fuel jet with a large jet cross section.

4. A burner according to claim 2 or 3, wherein at least some of the at least one first group of first fuel injection openings differ by having varying opening diameters of the fuel injection openings.

5. A burner according to claim 4, wherein remaining first fuel injection openings that are not arranged in said at least one first groups have a smaller opening diameter than the first fuel injection openings that are arranged in said at least one first groups.

6. A burner according to claim 1 or 2, wherein the injection angle of the first fuel injection openings alternates relative to the axial direction about the circumference between at least two values.

7. A burner according to claim 1 or 2, wherein the opening diameter of the first fuel injection openings alternates about the circumference between at least two values.

8. A burner according to claim 1 or 2, wherein a first set of said first fuel injection openings have a larger injection angle relative to the axial direction and have a larger opening diameter than a second set of said first fuel injection openings with a smaller injection angle.

9. A burner according to claim 1 or 2, wherein the injection angle relative to the radial direction is selected such that fuel jets of differing second groups exiting from the first fuel injection openings each intersect in different points outside a central burner axis.

10. A burner according to claim 1 or 2, wherein the first fuel injection openings are arranged distributed about the circumference of the burner at an end of the burner facing the combustion chamber.

11. A burner according to claim 10, wherein the first fuel injection openings are arranged in one row.

12. A burner according to claim 1 or 2, wherein the at least one first fuel line is mechanically decoupled from the swirler.

13. A burner according to claim 12, wherein the at least one first fuel line with the first fuel injection openings form a first element that encompasses the swirler, and wherein the swirler comprises openings at an end facing the combustion chamber configured and arranged for access of the first injection openings to an inner volume of the burner.

14. A burner according to claim 13, further comprising:

connecting straps; and wherein the first element is connected via the connecting straps to the swirler.

15. A burner according to claim 1 or 2, wherein the at least one first fuel line comprises an annular slot extending on the circumference of the swirler.

16. A burner according to claim 1 or 2, wherein the at least one first fuel line with the first fuel injection openings is arranged along the axial direction on the swirler.

17. A burner according to claim 1 or 2, further comprising:

at least one second fuel line including second fuel injection openings extending along the axial direction, arranged on the swirler.

18. A burner according to claim 17, wherein the at least one first fuel line has a cross section configured and arranged to permit a higher volume flow than that of the at least one second fuel line.

19. A burner according to claim 17, further comprising:

an inner volume;

an inner body arranged in the inner volume;

wherein the second fuel injection openings of the at least one second fuel line are arranged along the axial direction and distributed on the inner body.

20. A burner according to claim 17, wherein the second fuel injection openings are formed such that the opening diameter of the second fuel injection openings, an injection angle of the second fuel injection openings, or both, varies relative to the axial direction, the radial direction, or both, along the fuel lines, about the circumference of the burner, or both.

21. A burner according to claim 17, wherein at least some of the second fuel injection openings are arranged in at least one third group of closely spaced fuel injection openings so that each of the at least one third group generates a fuel jet with a large jet diameter.

22. A burner according to claim 17, further comprising:

means for independently controlling the premix fuel supply to the at least one first fuel line and to the at least one second fuel line.

23. A burner according to claim 1 or 2, wherein the swirler comprises a swirler grid.

24. A burner according to claim 1 or 2, wherein the combustion air inlet openings comprise tangential inlet slots extending in an axial direction.

25. A method for operating a burner, the method comprising:

providing a burner according to claim 17; and supplying synthesis gas via the at least one first fuel line; and supplying natural gas via the at least one second fuel line.

26. A burner according to claim 1 or 2, wherein the first fuel injection openings are arranged at an end of the burner facing a combustion chamber and are distributed about the circumference of the burner.

27. A gas turbine comprising:

at least one burner according to claim 1 or 2.

* * * * *